US010968849B2

(12) United States Patent
Yamamura

(10) Patent No.: US 10,968,849 B2
(45) Date of Patent: Apr. 6, 2021

(54) ENGINE SYSTEM

(71) Applicant: HONDA MOTOR CO., LTD., Tokyo (JP)

(72) Inventor: Yoichi Yamamura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/560,008

(22) Filed: Sep. 4, 2019

(65) Prior Publication Data

US 2019/0390621 A1 Dec. 26, 2019

Related U.S. Application Data

(63) Continuation of application No. PCT/JP2017/041236, filed on Nov. 16, 2017.

(30) Foreign Application Priority Data

Apr. 4, 2017 (JP) ..... JP2017-074716

(51) Int. Cl.
*F02D 41/06* (2006.01)
*F02M 51/00* (2006.01)
(Continued)

(52) U.S. Cl.
CPC ..... *F02D 41/062* (2013.01); *F02B 63/042* (2013.01); *F02D 29/06* (2013.01);
(Continued)

(58) Field of Classification Search
CPC ..... F02D 41/062; F02D 29/06; F02D 41/009; F02D 41/3082; F02D 43/00;
(Continued)

(56) References Cited

U.S. PATENT DOCUMENTS 6,868,832 B2 * 3/2005 Tamechika ..... F02D 37/02 123/406.23
2002/0167174 A1 * 11/2002 Haass ..... F02B 63/04 290/1 A
(Continued)

FOREIGN PATENT DOCUMENTS

EP 0 646 723 A1 4/1995
EP 2 031 218 A2 3/2009
(Continued)

OTHER PUBLICATIONS

International Search Report dated Feb. 13, 2018, issued in counterpart International Application No. PCT/JP2017/041236, with English Translation. (3 pages).
(Continued)

*Primary Examiner* — David Hamaoui
*Assistant Examiner* — John D Bailey
(74) *Attorney, Agent, or Firm* — Westerman, Hattori, Daniels & Adrian, LLP

(57) ABSTRACT

An engine system comprises a fuel tank, an internal combustion engine, a generator, a recoil starter, a control unit, an injector, a fuel pump, an ignition apparatus, and a detection unit that detects a number-of-rotations of the internal combustion engine. The control unit, in a starting period of the internal combustion engine using the recoil starter, determines whether or not the internal combustion engine can perform self-sustaining rotation based on the number-of-rotations, and if the internal combustion engine cannot perform self-sustaining rotation. Electric power is not supplied to the ignition apparatus, the injector, and the fuel pump when the internal combustion engine cannot perform self-sustaining rotation. The electric power is supplied to them when the internal combustion engine can perform self-sustaining rotation.

5 Claims, 8 Drawing Sheets

(51) Int. Cl.

| | |
|---|---|
| ***F02D 43/00*** | (2006.01) |
| ***F02D 41/00*** | (2006.01) |
| ***F02D 41/30*** | (2006.01) |
| ***F02M 37/10*** | (2006.01) |
| ***F02N 3/02*** | (2006.01) |
| ***F02B 63/04*** | (2006.01) |
| ***F02P 7/07*** | (2006.01) |
| ***F02D 29/06*** | (2006.01) |

(52) U.S. Cl.
CPC ..... *F02D 41/009* (2013.01); *F02D 41/3082* (2013.01); *F02D 43/00* (2013.01); *F02M 37/10* (2013.01); *F02M 51/005* (2013.01); *F02N 3/02* (2013.01); *F02P 7/07* (2013.01); *F02D 2041/0092* (2013.01)

(58) Field of Classification Search
CPC ..... F02D 2041/0092; F02B 63/042; F02M 37/10; F02M 51/005; F02N 3/02; F02P 7/07
USPC ..... 123/185.3
See application file for complete search history.

(56) References Cited

U.S. PATENT DOCUMENTS

2003/0209909 A1* 11/2003 Fukaya ..... F02D 13/04 290/40 A
2003/0217722 A1* 11/2003 Kobayashi ..... F02D 15/04 123/182.1
2004/0008009 A1* 1/2004 Fukaya ..... F02D 13/04 322/44
2005/0005914 A1* 1/2005 Tamechika ..... F02N 3/00 123/478
2005/0103301 A1* 5/2005 Namari ..... F02N 11/04 123/179.3
2009/0020092 A1* 1/2009 Kishibata ..... F02D 41/062 123/179.3
2009/0063014 A1* 3/2009 Tokugawa ..... F02P 7/067 701/103
2010/0019508 A1* 1/2010 Hashimoto ..... F02D 29/06 290/40 B
2014/0053820 A1* 2/2014 Takeshige ..... F02P 1/04 123/609
2018/0087464 A1* 3/2018 Sekita ..... F02N 11/0862

FOREIGN PATENT DOCUMENTS

| | | | |
|---|---|---|---|
| EP | 2 703 637 | A1 | 3/2014 |
| JP | 2005-61302 | A | 3/2005 |
| JP | 2005-307855 | A | 11/2005 |
| JP | 2007-40252 | A | 2/2007 |
| JP | 4159040 | B2 | 10/2008 |

OTHER PUBLICATIONS

Extended Search Report dated Mar. 30, 2020, issued in counterpart EP Application No. 17904952.3 (8 pages).

* cited by examiner

ENGINE SYSTEM

CROSS-REFERENCE TO RELATED APPLICATIONS

This application is a continuation of International Patent Application No. PCT/JP2017/041236 filed on Nov. 16, 2017, which claims priority to and the benefit of Japanese Patent Application No. 2017-074716 filed on Apr. 4, 2017, the entire disclosures of which are incorporated herein by reference.

TECHNICAL FIELD

The present invention relates to an electronic fuel injection control system and an engine system.

BACKGROUND ART

An engine system that generates electric power by driving a generator using an internal combustion engine is a useful power supply in regions in which the use of electric power grids are not wide spread, or when a commercial power supply is interrupted. According to Patent Literature 1, providing a back-up battery is proposed in order to supplement electric power that is insufficient when an engine system including a recoil starter, which is a manual operation type engine starter apparatus, is started.

CITATION LIST

Patent Literature

PTL 1: Japanese Patent No. 4159040

SUMMARY OF INVENTION

Technical Problem

With the method disclosed in Patent Literature 1, electric power sufficient for an electronic fuel injection apparatus is supplied by providing a back-up battery. However, as a result of providing the back-up battery, the manufacturing cost of the engine system increases. Also, if depending only on power of a recoil operator without providing the back-up battery, the operator is burdened with a heavy task. That is, starting the engine causes the operator to feel a heavy load. Therefore, the present invention aims to reduce a load felt by a recoil operator when starting an internal combustion engine.

Solution to Problem

According to the present invention, a batteryless engine system can be provided, for example. The batteryless engine system is including:

a fuel tank for containing fuel;

an internal combustion engine;

a generator that is driven by the internal combustion engine and produces electric power;

a recoil starter for starting the internal combustion engine;

a control unit that operates with electric power generated by the generator;

an injector that operates with electric power generated by the generator, is controlled by the control unit, and supplies fuel to the internal combustion engine;

a fuel pump that operates with electric power generated by the generator, is controlled by the control unit, and supplies fuel contained in the fuel tank to the injector;

an ignition apparatus that ignites fuel compressed in the internal combustion engine; and a power supply line that supplies electric power generated by the generator to the ignition apparatus, the injector, and the fuel pump;

a switch provided for the power supply line, the switch being switched from OFF to ON when electric power generated by the generator is supplied to the ignition apparatus, the injector, and the fuel pump, and the switch being switched from ON to OFF when electric power generated by the generator is not supplied to the ignition apparatus, the injector, and the fuel pump; and a detection unit that detects a number-of-rotations of the internal combustion engine, wherein the control unit, in a starting period of the internal combustion engine, which is started using the recoil starter, determines whether or not the internal combustion engine can perform self-sustaining rotation based on the number-of-rotations, and if the internal combustion engine cannot perform self-sustaining rotation, reduces a load for the recoil starter by not supplying electric power from the generator to the ignition apparatus, the injector, and the fuel pump by maintaining the switch being OFF, and if the internal combustion engine can perform self-sustaining rotation, supplies electric power from the generator to the ignition apparatus, the injector, and the fuel pump by switching the switch from OFF to ON.

Advantageous Effects of Invention

According to the present invention, the load felt by a recoil operator when an internal combustion engine is started can be reduced.

Other features and advantages of the present invention will be apparent from the following description taken in conjunction with the accompanying drawings. Note that the same reference numerals denote the same or similar components throughout the accompanying drawings.

BRIEF DESCRIPTION OF DRAWINGS

The accompanying drawings are included in the description, constitute part thereof, show embodiments of the present invention, and are used, together with the descriptions thereof, to explain the concept of the present invention.

DESCRIPTION OF EMBODIMENTS

Engine System

Figure 1:
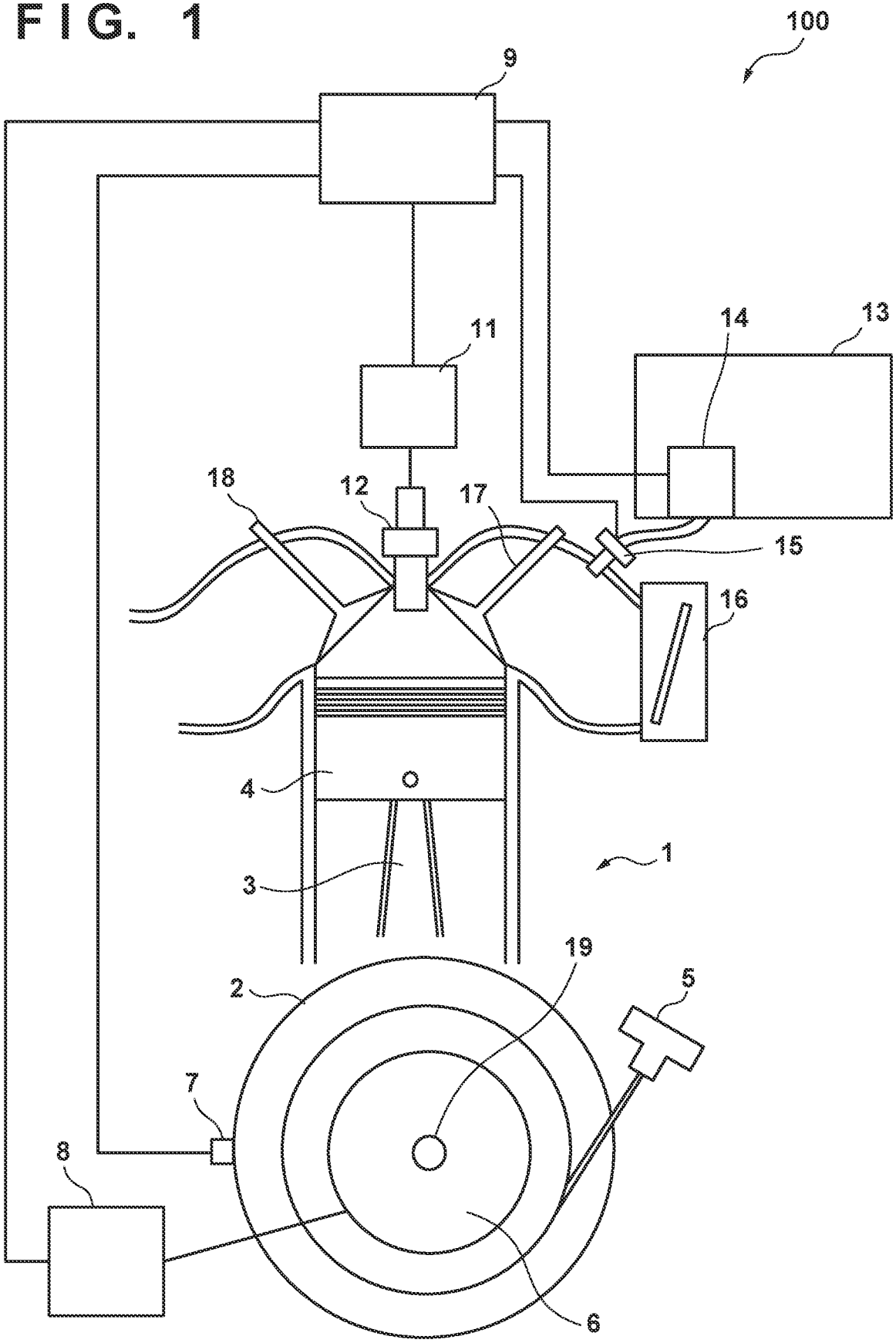
FIG. 1 is a schematic diagram illustrating an engine system.

FIG. 1 is a schematic diagram illustrating a batteryless engine system 100. The engine system 100 may also be referred to as an electronic fuel injection control system. An internal combustion engine 1 is a four-stroke-type engine. A crank shaft 19 is housed in a crankcase 2. As a result of the crank shaft 19 rotating, a piston 4 coupled to a connecting rod 3 is brought into vertical motion inside a cylinder. A recoil starter 5 for starting the internal combustion engine 1 is coupled to the crank shaft 19. A recoil operator causes the crank shaft 19 to rotate by grasping and pulling a grip of the recoil starter 5. A generator 6 is coupled to the crank shaft 19, and as a result of the crank shaft 19 rotating, a rotor of the generator 6 rotates, and the generator 6 generates electric power. The crank angle of the crank shaft 19 is detected by a crank angle sensor 7. The crank angle sensor 7 may be a Hall element that detects the magnetism of a magnet provided in a flywheel coupled to the crank shaft 19, for example. The power supply circuit 8 includes a circuit that converts an alternating current generated by the generator 6 to a direct current, a circuit that shift the level of a DC voltage, and the like. The power supply circuit 8 supplies electric power generated by the generator 6 to a control unit 9. Note that, when the crank shaft 19 is rotated by the recoil starter 5, the generator 6 generates electric power that is sufficient for the control unit 9 to operate. The control unit 9 is an engine control unit (ECU), and controls electric power to be supplied from the power supply circuit 8 to an ignition apparatus 11, a fuel pump 14, an injector 15, a throttle motor 16, and the like. The ignition apparatus 11 supplies ignition power for causing the ignition plug 12 to spark-discharge. A fuel tank 13 is a container that contains fuel. The fuel pump 14 is a pump for supplying fuel contained in the fuel tank 13 to the injector 15. In FIG. 1, the fuel pump 14 is provided inside the fuel tank. The throttle motor 16 is a motor for controlling an air inflow amount. An intake valve 17 is a valve that is opened/closed by a cam or the like that converts a rotational motion of the crank shaft 19 into vertical motion. The intake valve 17 opens in an intake stroke, and is basically closed in a compression stroke, an expansion stroke, and an exhaust stroke. An exhaust valve 18 is a valve that is opened/closed by a cam or the like that converts rotational motion of the crank shaft 19 into vertical motion. The exhaust valve 18 opens in the exhaust stroke, and is basically closed in the compression stroke, the expansion stroke, and the intake stroke. A period may be provided in which both the intake valve 17 and the exhaust valve 18 are open at the same time in order to make the transition from exhaust to intake smooth (overlap).

Incidentally, the total value of power consumption of the control unit 9, the fuel pump 14, the ignition apparatus 11, and the injector 15 may reach several tens of watts. If this electric power is supplied only by the generator 6 without using a back-up battery, a large recoil power is needed. That is, the recoil operator is required to perform a heavy physical task. Therefore, the control unit 9 reduces the load felt by the operator by limiting power supply to the ignition apparatus 11, the injector 15, and the fuel pump 14 in a starting period of the internal combustion engine 1, which is started using the recoil starter 5. For example, the control unit 9 refers to a number-of-rotations and an acceleration, and if the internal combustion engine 1 cannot perform self-sustaining rotation, the control unit 9 does not supply electric power from the generator 6 to the ignition apparatus 11, the injector 15, and the fuel pump 14. If the internal combustion engine 1 can perform self-sustaining rotation, the control unit 9 supplies electric power from the generator 6 to the ignition apparatus 11, the injector 15, and the fuel pump 14. Accordingly, the load felt by the recoil operator can be reduced in the starting period.

Timing at which Electric Power is Supplied

Figure 2:
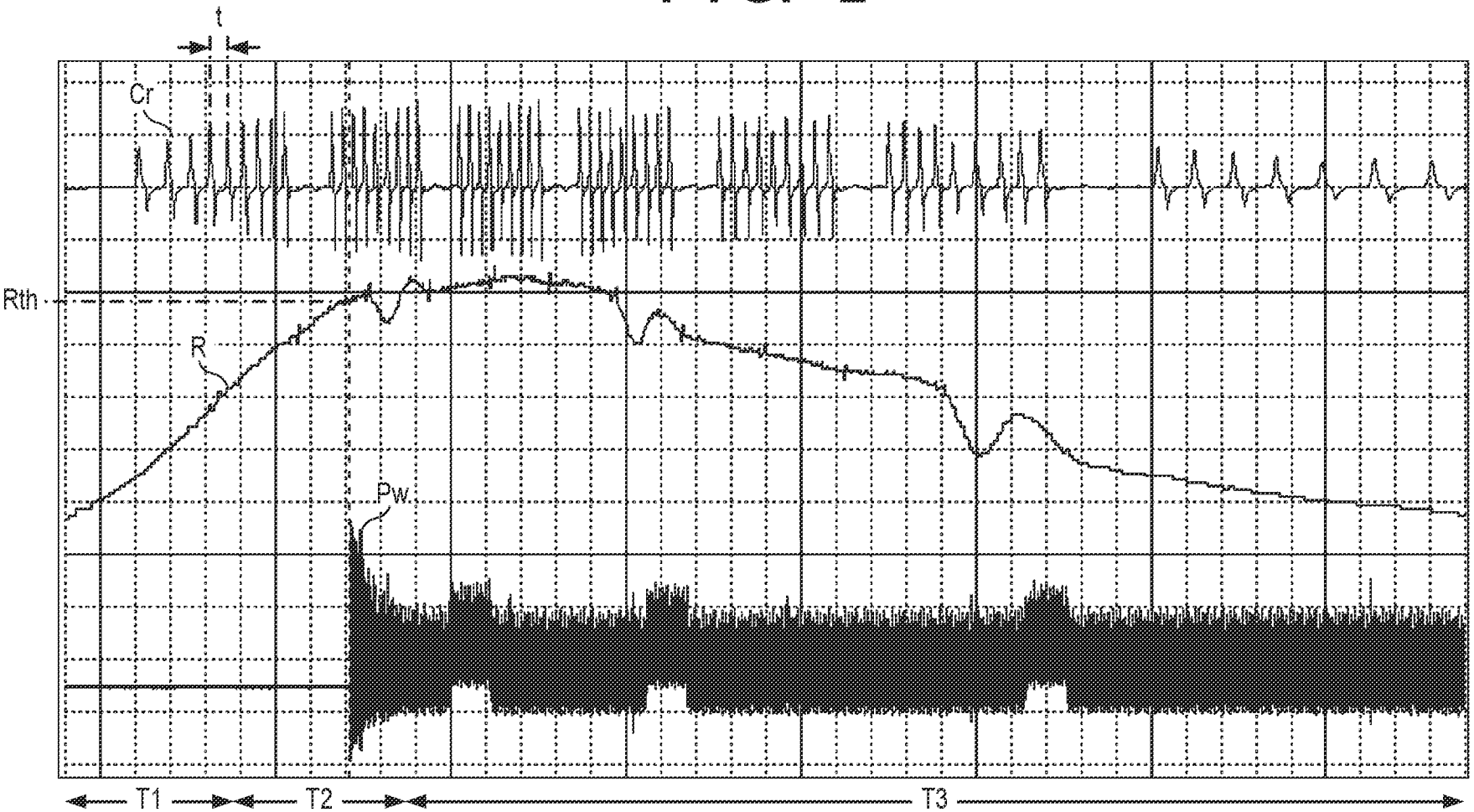
FIG. 2 is a diagram illustrating relationship between the number-of-rotations and the start timing of an electric power supply.

FIG. 2 shows the relationship between a pulse signal Cr output by the crank angle sensor 7, the number-of-rotations R of the internal combustion engine 1, and the power consumption Pw of the ignition apparatus 11, the injector 15, and the fuel pump 14. T1 indicates an initial period of a recoil operation. Empirically, an operator is sensitive to the load in T1. T2 indicates a middle period and an end period of the recoil operation. Empirically, the operator is not sensitive to the load in T2. T3 indicates a period in which the recoil operation has ended and the internal combustion engine 1 is rotating due to inertia moment. In T3, since the recoil operation has ended, the operator does not feel the load.

According to FIG. 2, when the number-of-rotations R has reached a prescribed number-of-rotations (threshold value Rth) or more, the control unit 9 starts supplying electric power from the generator 6 to the ignition apparatus 11, the injector 15, and the fuel pump 14. The threshold value Rth is a number-of-rotations at which the internal combustion engine 1 can perform self-sustaining rotation. The threshold value Rth is a number-of-rotations at which the inertia moment of the internal combustion engine 1 generates inertia moment with which the internal combustion engine 1 can perform self-sustaining rotation, for example. Electric power is not supplied to the ignition apparatus 11, the injector 15, and the fuel pump 14 until the number-of-rotations R has reached the threshold value Rth. Therefore, the load felt by the operator through the recoil starter 5 can be reduced. Also, since the operator is already insensitive to the load in the end period of the recoil operation, even if electric power is supplied to the ignition apparatus 11, the injector 15, and the fuel pump 14, the operator may not mind the load.

First Embodiment

Control Unit and Power Supply Circuit

Figure 3:
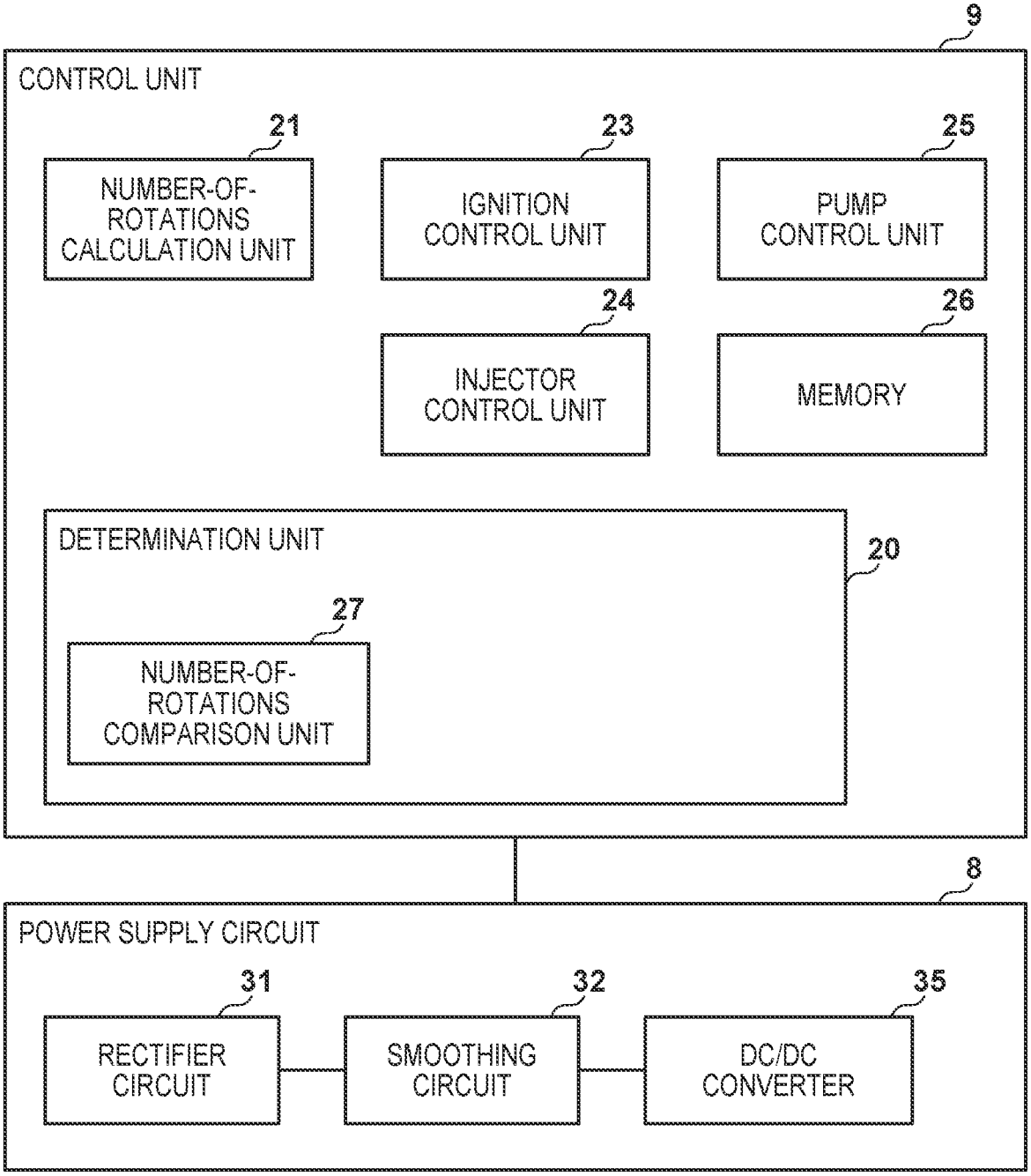
FIG. 3 is a block diagram illustrating a control unit and a power supply circuit.

FIG. 3 shows the functions of the control unit 9 and the power supply circuit 8. In the control unit 9, a number-of-rotations calculation unit 21 calculates and acquires the number-of-rotations based on the intervals of pulse signals output from the crank angle sensor 7. The crank angle sensor 7 outputs a pulse every time the crank shaft 19 has rotated 30 degrees, and, after outputting nine pulses, does not output a pulse while rotating 120 degrees. Specifically, focusing on the nine pulses, the pulse interval decreases as the number-of-rotations of the crank shaft 19 increases. This pulse interval represents the time needed for the crank shaft 19 to rotate 30 degrees. Therefore, the number-of-rotations calculation unit 21 measures a pulse interval t using a timer and a counter, and acquires the number-of-rotations R by calculating the expression (30 degrees/360 degrees)/t. A determination unit 20 determines whether or not the internal combustion engine 1 can perform self-sustaining rotation based on the number-of-rotations R. A number-of-rotations comparison unit 27 determines whether or not the number-of-rotations R is greater than or equal to a threshold value Rth by comparing the number-of-rotations R with the threshold value Rth. If the number-of-rotations R is greater than or equal to the threshold value Rth, the determination unit 20 may determine that the internal combustion engine 1 can perform self-sustaining rotation, and outputs a power supply enabling signal. Alternatively, if the number-of-rotations R is less than the threshold value Rth, the determination unit 20 determines that the internal combustion engine 1 cannot perform self-sustaining rotation, and does not output the power supply enabling signal (or outputs a power supply disabling signal). When the determination unit 20 outputs the power supply enabling signal, an ignition control unit 23 starts supplying electric power to the ignition apparatus 11, and when the determination unit 20 does not output the power supply enabling signal, the ignition control unit 23 does not supply electric power to the ignition apparatus 11. When the determination unit 20 outputs the power supply enabling signal, an injector control unit 24 starts supplying electric power to the injector 15, and when the determination unit 20 does not output the power supply enabling signal, the injector control unit 24 does not supply electric power to the injector 15. When the determination unit 20 outputs the power supply enabling signal, a pump control unit 25 starts supplying electric power to the fuel pump 14, and when the determination unit 20 does not output the power supply enabling signal, the pump control unit 25 does not supply electric power to the fuel pump 14. Note that a memory 26 stores the threshold value Rth and the like. The memory 26 is a storage apparatus including a RAM, a ROM, and the like. The power supply is started when a switch such as a relay or a semiconductor switch that is provided in a power supply line from the power supply circuit 8 to the ignition apparatus 11, the injector 15, and the fuel pump 14 is switched from OFF to ON. For example, this switch is provided inside the power supply circuit 8, and is provided with respect to each of the ignition apparatus 11, the injector 15, and the fuel pump 14.

The amount of fuel needed by the internal combustion engine 1 in an operation period depends on the size of a load that operates with the electric power supplied from the engine system 100. Therefore, the pump control unit 25 may perform PWM control with respect to the period during which electric power is supplied to the fuel pump 14 according to the size of the load. That is, the length of an ON period (on-duty) of a pulse-like drive signal that is supplied to the fuel pump 14 may be variably controlled according to the size of the load. With this, the power consumption and the heat generation amount of the fuel pump 14 can be reduced.

In the power supply circuit 8, a rectifier circuit 31 is a circuit for rectifying an alternating current generated by the generator 6. A smoothing circuit 32 is a circuit for generating a direct current by smoothing a pulsating current generated by the rectifier circuit 31. With this, a 12 V DC voltage is generated, for example. The control unit 9 may perform PWM control with respect to the electric power supplied to the fuel pump 14 according to the load of the generator 6 and the internal combustion engine 1. A DC/DC converter 35 is a circuit for shifting the level of the DC voltage. For example, the DC/DC converter 35 converts a 12 V DC voltage to a 5 V or 3.3 V DC voltage.

Flowchart

Figure 4:
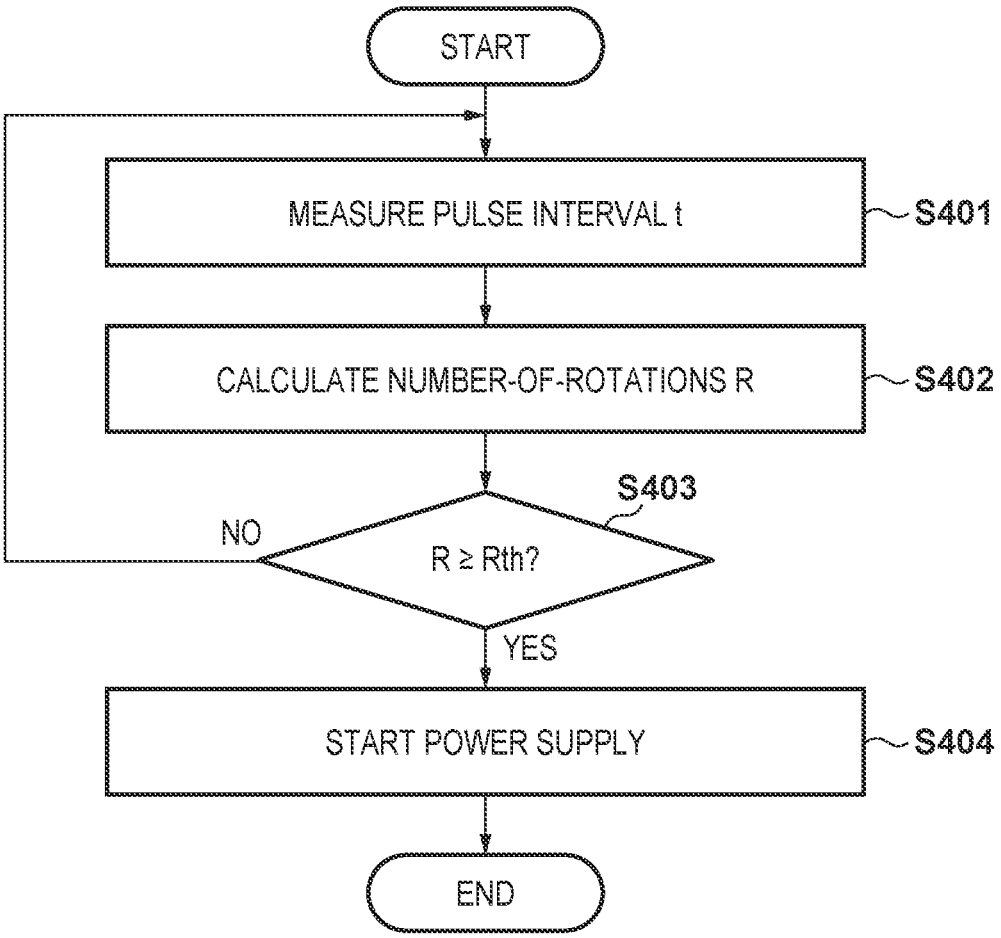
FIG. 4 is a flowchart illustrating electric power control.

FIG. 4 is a flowchart illustrating electric power control in a starting period. When the control unit 9 is started by receiving the supply of electric power generated by the generator 6 through the power supply circuit 8, the control unit 9 executes the following processing.

In step S401, the number-of-rotations calculation unit 21 of the control unit 9 measures the pulse interval t using a timer and a counter. Note that the timer and the counter may be provided outside the number-of-rotations calculation unit 21 as a detection unit or a measurement unit of the pulse interval t.

In step S402, the number-of-rotations calculation unit 21 of the control unit 9 calculates the number-of-rotations R based on the measured pulse interval t. Note that, as FIG. 2 shows, the pulse intervals t between adjacent pulses of first to ninth pulses are almost the same, but the pulse interval between the ninth pulse and a tenth pulse (first pulse in a second cycle) is extremely long. Therefore, the number-of-rotations calculation unit 21 calculates the number-of-rotations R while excluding the extremely long pulse interval.

In step S403, the number-of-rotations comparison unit 27 of the control unit 9 determines whether or not the number-of-rotations R acquired by calculation is greater than or equal to the threshold value Rth read out from the memory 26. If the number-of-rotations R is less than the threshold value Rth, since the internal combustion engine 1 cannot perform self-sustaining rotation, the number-of-rotations comparison unit 27 returns the processing to step S401 for measuring the next pulse interval t. On the other hand, if the number-of-rotations R is greater than or equal to the threshold value Rth, since the internal combustion engine 1 can perform self-sustaining rotation, the number-of-rotations comparison unit 27 advances the processing to step S404.

In step S404, the control unit 9 starts supplying electric power to the ignition apparatus 11, the injector 15, and the fuel pump 14.

As described above, in the starting period of the internal combustion engine 1 using the recoil starter 5, the control unit 9 does not supply electric power from the generator 6 to auxiliary machines (ignition apparatus 11, injector 15, and fuel pump 14) relating to fuel injection and ignition until the number-of-rotations R becomes greater than or equal to the prescribed number-of-rotations. When the number-of-rotations R becomes greater than or equal to the prescribed number-of-rotations, the control unit 9 supplies electric power from the generator to the ignition apparatus 11, the injector 15, and the fuel pump 14. That is, electric power is not supplied to the auxiliary machines in a first period from when the recoil starter 5 begins to be pulled until when the number-of-rotations R becomes greater than or equal to the prescribed number-of-rotations, and electric power is supplied to the auxiliary machines in a second period after the number-of-rotations R has become greater than or equal to the prescribed number-of-rotations. With this, it is possible to reduce the load felt by the recoil operator when the internal combustion engine 1 is started.

Second Embodiment

Control Unit and Power Supply Circuit

In the first embodiment, whether or not power supply to the ignition apparatus 11, the injector 15, and the fuel pump 14 is started is determined based on the number-of-rotations R. In a second embodiment, whether or not power supply to the ignition apparatus 11, the injector 15, and the fuel pump 14 is started is determined based on whether or not the acceleration of the internal combustion engine 1 obtained from the pulse interval t is less than a threshold value. In general, the operator grasps the grip of the recoil starter 5, and pulls the recoil starter 5 without a pause. Also, because the cable (string) connected to the grip has a fixed length, the acceleration of the crank shaft 19 starts decreasing in the middle of the pulling operation. According to FIG. 2, a constant acceleration continues from approximately the start of the operation, and around a time instant at which the number-of-rotations R reaches the threshold value Rth, the acceleration has begun to decrease. Therefore, whether or not the internal combustion engine 1 can perform self-sustaining rotation, or whether or not power supply to the ignition apparatus 11, the injector 15, and the fuel pump 14 should be started can be determined based on the acceleration of the crank shaft 19.

Figure 5:
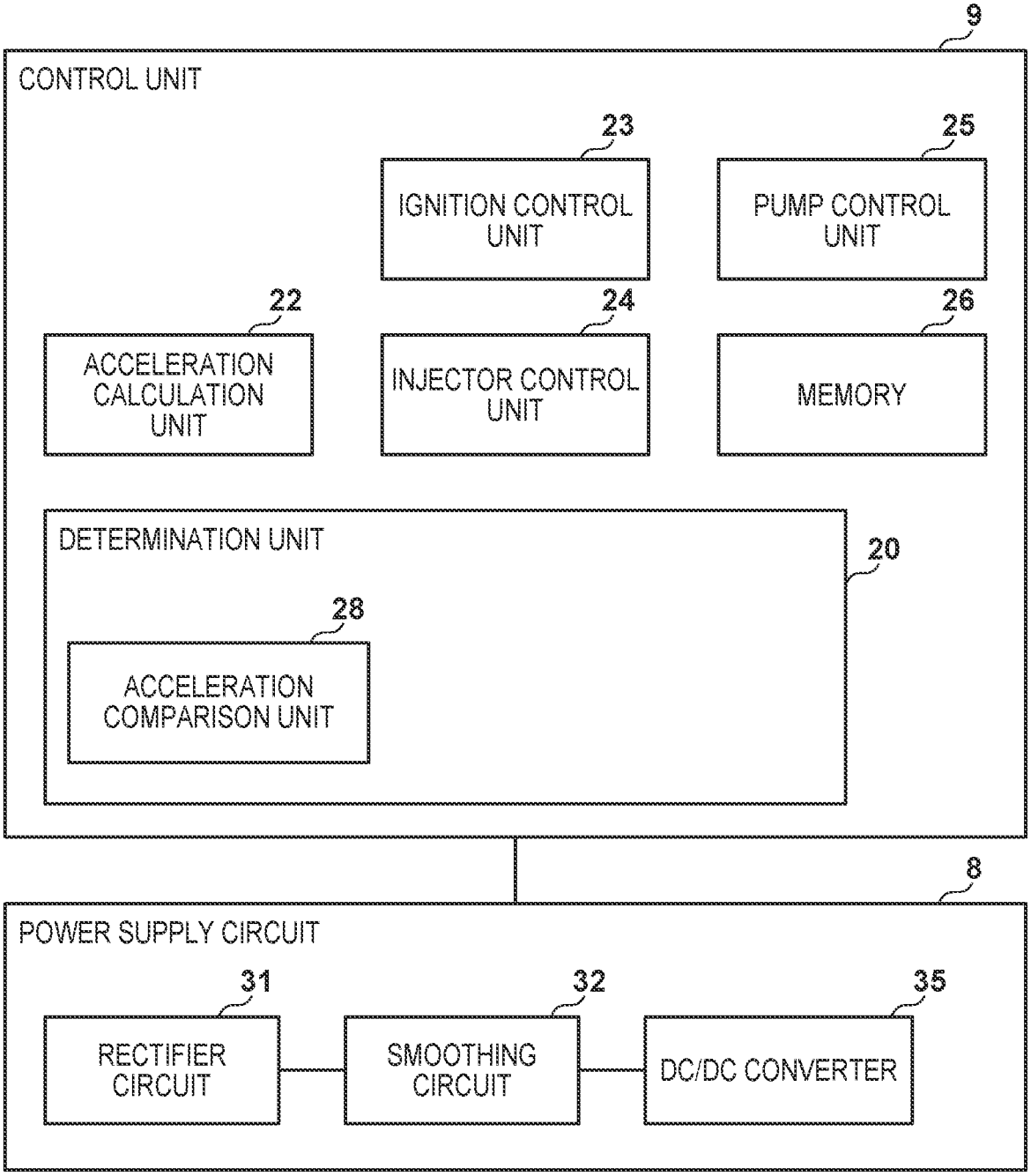
FIG. 5 is a block diagram illustrating a control unit and a power supply circuit.

FIG. 5 shows the functions of the control unit 9 and the power supply circuit 8. In FIG. 5, items in common with those in FIG. 3 are given the same reference numbers. An acceleration calculation unit 22 measures the pulse intervals t of pulse signals output from the crank angle sensor 7, and calculates and acquires the acceleration a of the crank shaft 19 based on the pulse intervals t. Note that the acceleration calculation unit 22 may calculate the acceleration a based on the number-of-rotations Ri−1 and Ri (i is a pulse number and an integer of 1 to 9) detected by the number-of-rotations calculation unit 21. This is because the acceleration a is a parameter indicating the increasing rate of the number-of-rotations. In this way, the acceleration calculation unit 22 may calculate the acceleration a by differentiating the number-of-rotations R detected by the number-of-rotations calculation unit 21. An acceleration comparison unit 28 determines whether or not the acceleration a is greater than or equal to a prescribed acceleration ath. For example, if the acceleration a is greater than or equal to the prescribed acceleration ath, the acceleration comparison unit 28 does not output a power supply enabling signal. On the other hand, if the acceleration a is less than the prescribed acceleration ath, the acceleration comparison unit 28 outputs the power supply enabling signal. When the power supply enabling signal is not output, the ignition control unit 23 does not supply electric power from the generator 6 to the ignition apparatus 11. When the power supply enabling signal is not output, the injector control unit 24 does not supply electric power from the generator 6 to the injector 15. When the power supply enabling signal is not output, the pump control unit 25 does not supply electric power from the generator 6 to the fuel pump 14. When the acceleration a is no longer greater than or equal to the prescribed acceleration ath, the acceleration comparison unit 28 outputs the power supply enabling signal. Accordingly, the control unit 9 supplies electric power from the generator 6 to the ignition apparatus 11, the injector 15, and the fuel pump 14.

Flowchart

Figure 6:
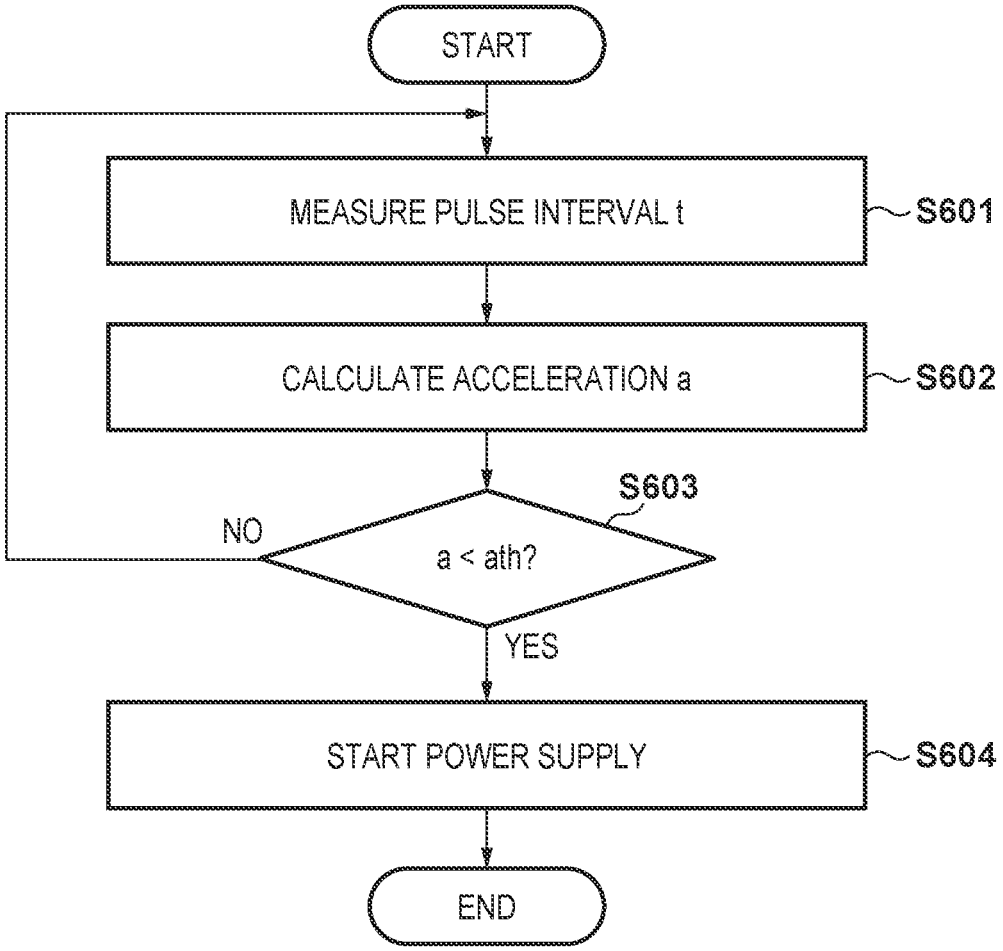
FIG. 6 is a flowchart illustrating electric power control.

FIG. 6 is a flowchart illustrating electric power control in the starting period. When the control unit 9 is started by receiving the supply of electric power generated by the generator 6 through the power supply circuit 8, the control unit 9 executes the following processing.

In step S601, the acceleration calculation unit 22 of the control unit 9 measures the pulse intervals t using a timer and a counter. Note that the timer and the counter may be provided outside the acceleration calculation unit 22 as a detection unit or a measurement unit of the pulse interval t.

In step S602, the acceleration calculation unit 22 of the control unit 9 calculates the acceleration a based on the measured pulse intervals t. The acceleration may be calculated based on the number-of-rotations detected by the number-of-rotations calculation unit 21. As FIG. 2 shows, the pulse intervals t between adjacent pulses of first to ninth pulses are almost the same, but the pulse interval between the ninth pulse and a tenth pulse (first pulse in a second cycle) is extremely long. Therefore, the acceleration calculation unit 22 calculates the acceleration a while excluding the extremely long pulse interval.

In step S603, the acceleration comparison unit 28 of the control unit 9 determines whether or not the acceleration a acquired by calculation is less than the prescribed acceleration ath read out from the memory 26. If the acceleration a is not less than the prescribed acceleration ath (that is, if the acceleration a is greater than or equal to the prescribed acceleration ath), the acceleration comparison unit 28 returns the processing to step S601 for measuring the next pulse interval t. On the other hand, if the acceleration a is less than the prescribed acceleration ath (if the acceleration a is no longer greater than or equal to the prescribed acceleration ath), the acceleration comparison unit 28 advances the processing to step S604.

In step S604, the control unit 9 starts supplying electric power (power supply) to the ignition apparatus 11, the injector 15, and the fuel pump 14.

As described above, in the starting period of the internal combustion engine 1 using the recoil starter 5, the control unit 9 does not supply electric power from the generator 6 to ignition apparatus 11, the injector 15, and the fuel pump 14 when the acceleration a is greater than or equal to the prescribed acceleration ath. Incidentally, the acceleration a is a parameter indicating the increase of the number-of-rotations R detected by the number-of-rotations calculation unit 21. That is, the control unit 9 does not supply electric power from the generator 6 to the ignition apparatus 11, the injector 15, and the fuel pump 14 while the number-of-rotations R increases. On the other hand, when the acceleration a is no longer greater than or equal to the prescribed acceleration ath, the control unit 9 starts supplying electric power from the generator 6 to the ignition apparatus 11, the injector 15, and the fuel pump 14. That is, when the increase in the number-of-rotations R has ended, the control unit 9 starts supplying electric power. As describe above, electric power is not supplied to the auxiliary machines in a first period from when the recoil starter 5 began to be pulled until when the acceleration a decreases below the prescribed acceleration ath, and electric power is supplied to the auxiliary machines in a second period after the acceleration a has decreased below the prescribed acceleration ath. With this, it is possible to reduce the load felt by the recoil operator when the internal combustion engine 1 is started.

Third Embodiment

Control Unit and Power Supply Circuit

Figure 7:
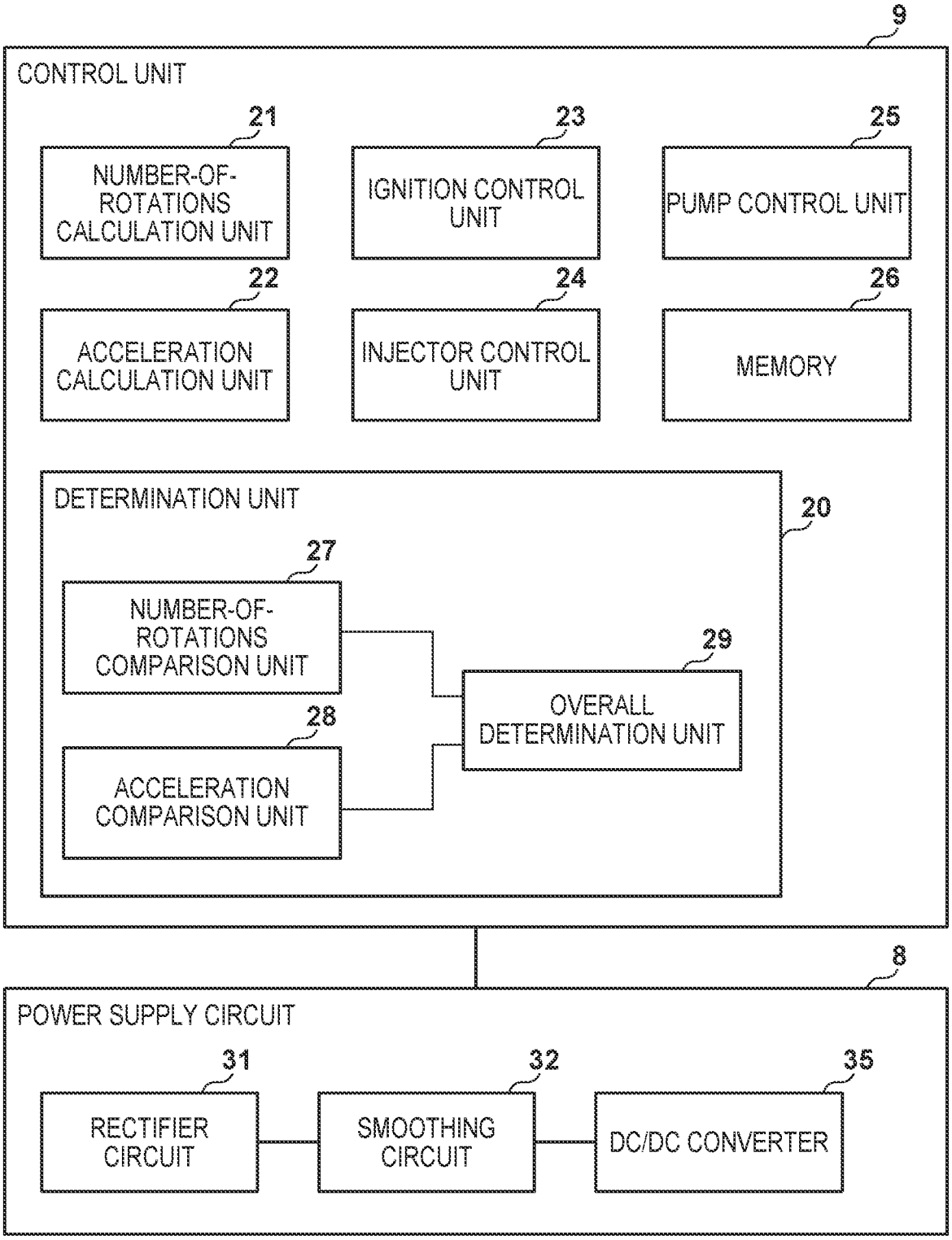
FIG. 7 is a block diagram illustrating a control unit and a power supply circuit.

In a third embodiment, whether or not electric power will be supplied is determined based on both of the number-of-rotations R and the acceleration a. FIG. 7 shows the functions of the control unit 9 and the power supply circuit 8. In FIG. 7, items in common with those in FIGS. 3 and 5 are given the same reference numbers. An overall determination unit 29 determines whether or not the number-of-rotations R is less than the threshold value Rth or whether or not the acceleration a is greater than or equal to the prescribed acceleration ath. If the number-of-rotations R is less than the threshold value Rth or if the acceleration a is greater than or equal to the prescribed acceleration ath, the control unit 9 does not supply electric power from the generator 6 to the ignition apparatus 11, the injector 15, and the fuel pump 14. If the number-of-rotations R is greater than or equal to the threshold value Rth and the acceleration a is less than the prescribed acceleration ath, the control unit 9 supplies electric power from the generator 6 to the ignition apparatus 11, the injector 15, and the fuel pump 14.

Flowchart

Figure 8:
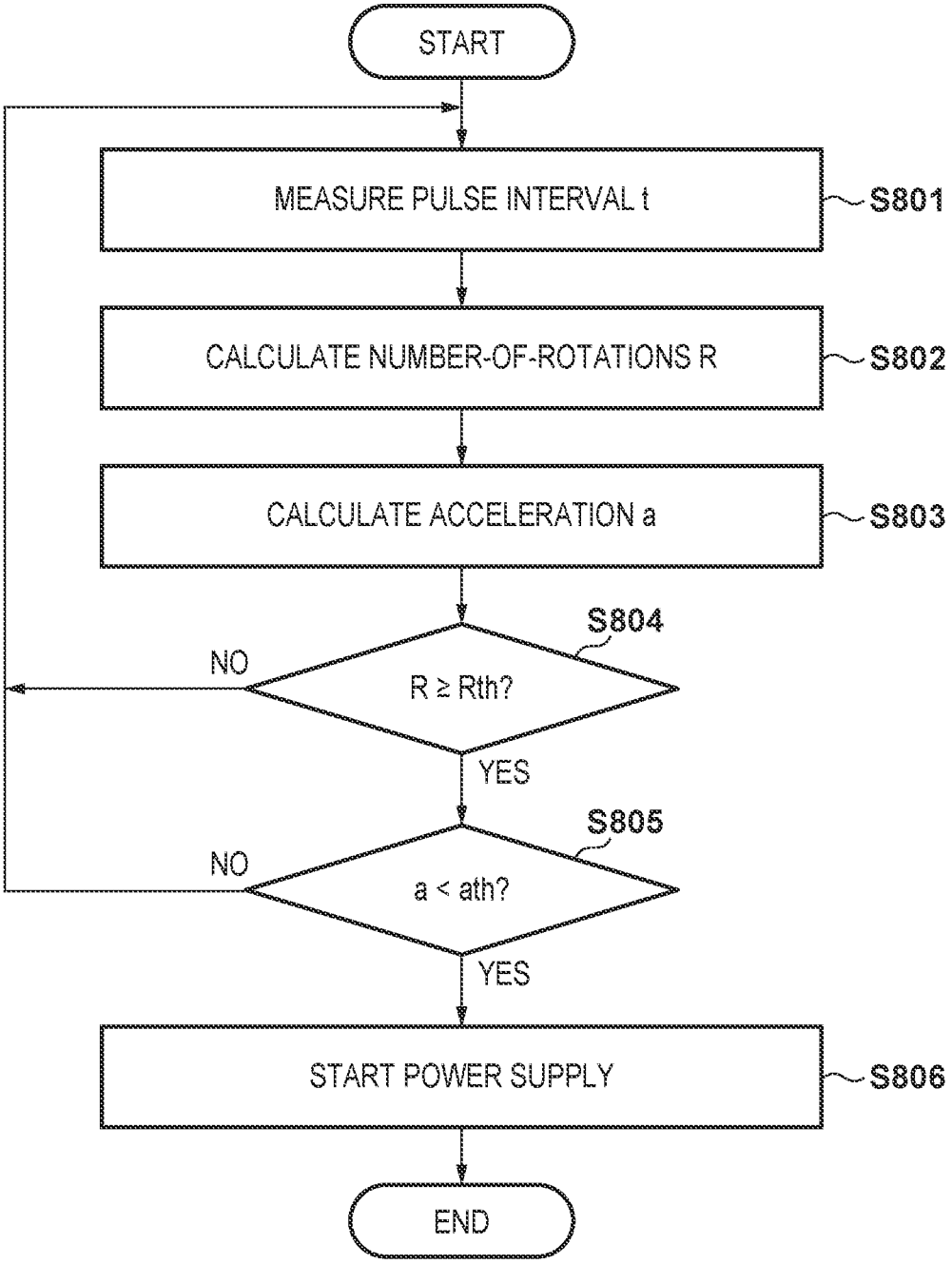
FIG. 8 is a flowchart illustrating electric power control.

FIG. 8 is a flowchart illustrating electric power control in the starting period. When the control unit 9 is started by receiving the supply of electric power generated by the generator 6 through the power supply circuit 8, the control unit 9 executes the following processing. The processing steps already described will be described in a concise manner.

In step S801, the number-of-rotations calculation unit 21 of the control unit 9 measures pulse intervals t using a timer and a counter.

In step S802, the number-of-rotations calculation unit 21 of the control unit 9 calculates the number-of-rotations R.

In step S803, the acceleration calculation unit 22 of the control unit 9 calculates the acceleration a.

In step S804, the number-of-rotations comparison unit 27 of the control unit 9 determines whether or not the number-of-rotations R is greater than or equal to the threshold value Rth. If the number-of-rotations R is not greater than or equal to the threshold value Rth, the control unit 9 returns the processing to step S801. On the other hand, if the number-of-rotations R is greater than or equal to the threshold value Rth, the control unit 9 advances the processing to step S805.

In step S805, the acceleration comparison unit 28 of the control unit 9 determines whether or not the acceleration a is less than the prescribed acceleration ath. If the acceleration a is not less than the prescribed acceleration ath (if the acceleration a is greater than or equal to the prescribed acceleration ath), the acceleration comparison unit 28 returns the processing to step S801. On the other hand, if the acceleration a is less than the prescribed acceleration ath (if the acceleration a is no longer greater than or equal to the prescribed acceleration ath), the acceleration comparison unit 28 advances the processing to step S806.

In step S806, the control unit 9 starts supplying electric power (power supply) to the ignition apparatus 11, the injector 15, and the fuel pump 14.

As described above, if the number-of-rotations R is less than the threshold value Rth, or if the acceleration a is greater than or equal to the prescribed acceleration ath, the control unit 9 does not supply electric power from the generator 6 to the ignition apparatus 11, the injector 15, and the fuel pump 14. On the other hand, if the number-of-rotations R is greater than or equal to the threshold value Rth and the acceleration a is less than the prescribed acceleration ath, the control unit 9 supplies electric power from the generator 6 to the ignition apparatus 11, the injector 15, and the fuel pump 14. With this, it is possible to reduce the load felt by the recoil operator when the internal combustion engine 1 is started.

SUMMARY

According to these embodiments, the engine system 100 includes the fuel tank 13 for containing fuel, the internal combustion engine 1, the generator 6 that is driven by the internal combustion engine 1 and generates electric power, the recoil starter 5 for starting the internal combustion engine 1, the control unit 9 that operates with electric power generated by the generator 6, the injector 15 that operates with electric power generated by the generator 6, is controlled by the control unit 9, and supplies fuel to the internal combustion engine 1, the fuel pump 14 that operates with electric power generated by the generator 6, is controlled by the control unit 9, and supplies fuel contained in the fuel tank 13 to the injector 15, the ignition apparatus 11 that ignites fuel compressed in the internal combustion engine 1, and the detection unit that detects the number-of-rotations R of the internal combustion engine 1. The crank angle sensor 7 or the like is an example of the detection unit that detects the number-of-rotations R of the internal combustion engine 1. The control unit 9 determines, in a starting period of the internal combustion engine 1, which is started using the recoil starter 5, whether or not the internal combustion engine 1 can perform self-sustaining rotation based on the number-of-rotations R. If the internal combustion engine 1 cannot perform self-sustaining rotation, the control unit 9 does not supply electric power from the generator 6 to the ignition apparatus 11, the injector 15, and the fuel pump 14. Also, if the internal combustion engine 1 can perform self-sustaining rotation, the control unit 9 supplies electric power from the generator 6 to the ignition apparatus 11, the injector 15, and the fuel pump 14. With this, it is possible to reduce the load felt by the recoil operator when the internal combustion engine 1 is started.

In a starting period of the internal combustion engine 1, which is started using the recoil starter 5, the control unit 9 does not supply electric power from the generator 6 to the ignition apparatus 11, the injector 15, and the fuel pump 14 until the number-of-rotations R becomes greater than or equal to a prescribed number-of-rotations (threshold value Rth, for example) at which the internal combustion engine 1 can perform self-sustaining rotation. Also, when the number-of-rotations R has become greater than or equal to the prescribed number-of-rotations, the control unit 9 supplies electric power from the generator 6 to the ignition apparatus 11, the injector 15, and the fuel pump 14. With this, it is possible to reduce the load felt by the recoil operator when the internal combustion engine 1 is started.

Also, in a starting period of the internal combustion engine 1, which is started using the recoil starter 5, the control unit 9 may not supply electric power from the generator 6 to the ignition apparatus 11, the injector 15, and the fuel pump 14 while the number-of-rotations R detected by the detection unit increases. Also, the control unit 9 may supply electric power from the generator 6 to the ignition apparatus 11, the injector 15, and the fuel pump 14 when the number-of-rotations R has stopped increasing.

For example, in a starting period of the internal combustion engine 1, which is started using the recoil starter 5, the control unit 9 obtains the acceleration a from the number-of-rotations R detected by the detection unit, and may not supply electric power from the generator 6 to the ignition apparatus 11, the injector 15, and the fuel pump 14 in a period in which the acceleration a is greater than or equal to the prescribed acceleration ath. Also, the control unit 9 may supply electric power from the generator 6 to the ignition apparatus 11, the injector 15, and the fuel pump 14 when the acceleration a is no longer greater than or equal to the prescribed acceleration ath.

The control unit 9 obtains the acceleration a from the number-of-rotations R detected by the detection unit, and may not supply electric power from the generator 6 to the ignition apparatus 11, the injector 15, and the fuel pump 14 if the number-of-rotations R is less than a prescribed number-of-rotations at which the internal combustion engine 1 can perform self-sustaining rotation, or if the acceleration a is greater than or equal to a prescribed acceleration. Also, when the number-of-rotations R becomes greater than or equal to the prescribed number-of-rotations at which the internal combustion engine 1 can perform self-sustaining rotation and if the acceleration is less than the prescribed acceleration, the control unit 9 may supply electric power from the generator 6 to the ignition apparatus 11, the injector 15, and the fuel pump 14.

Also, in a period from when the recoil starter 5 is started to be operated until the number-of-rotations R becomes greater than or equal to the prescribed number-of-rotations at which the internal combustion engine 1 can perform self-sustaining rotation, the control unit 9 need not supply electric power from the generator 6 to the ignition apparatus 11, the injector 15, and the fuel pump 14. Also, the control unit 9 may start supplying electric power from the generator 6 to the ignition apparatus 11, the injector 15, and the fuel pump 14 after the number-of-rotations R has become greater than or equal to the prescribed number-of-rotations.

The present invention is not limited to the above embodiments and various changes and modifications can be made within the spirit and scope of the present invention. Therefore, to apprise the public of the scope of the present invention, the following claims are made.

The invention claimed is:

1. A batteryless engine system comprising:

a fuel tank for containing fuel;

an internal combustion engine;

a generator that is driven by the internal combustion engine and produces electric power;

a recoil starter for starting the internal combustion engine;

a control unit that operates with electric power generated by the generator, an injector that operates with electric power generated by the generator, is controlled by the control unit, and supplies fuel to the internal combustion engine;

a fuel pump that operates with electric power generated by the generator, is controlled by the control unit, and supplies fuel contained in the fuel tank to the injector, an ignition apparatus that ignites fuel compressed in the internal combustion engine;

a power supply line that supplies electric power generated by the generator to the ignition apparatus, the injector, and the fuel pump;

a switch provided for the power supply line, the switch being switched from OFF to ON when electric power generated by the generator is supplied to the ignition apparatus, the injector, and the fuel pump, and the switch being switched from ON to OFF when electric power generated by the generator is not supplied to the ignition apparatus, the injector, and the fuel pump; and a detection unit that detects a number-of-rotations of the internal combustion engine, wherein the control unit, in a starting period of the internal combustion engine, which is started using the recoil starter, determines whether or not the internal combustion engine can perform self-sustaining rotation based on the number-of-rotations, and if the internal combustion engine cannot perform self-sustaining rotation, reduces a load for the recoil starter by not supplying electric power from the generator to the ignition apparatus, the injector, and the fuel pump by maintaining the switch being OFF, and if the internal combustion engine can perform self-sustaining rotation, supplies electric power from the generator to the ignition apparatus, the injector, and the fuel pump by switching the switch from OFF to ON, and wherein the control unit, in a starting period of the internal combustion engine, which is started using the recoil starter, obtains acceleration from the number-of-rotations detected by the detection unit, does not supply electric power from the generator to the ignition apparatus, the injector, and the fuel pump in a period in which the acceleration is greater than or equal to a prescribed acceleration, and supplies electric power from the generator to the ignition apparatus, the injector, and the fuel pump when the acceleration is no longer greater than or equal to the prescribed acceleration.

2. The batteryless engine system according to claim 1, wherein the control unit determines that the internal combustion engine can perform self-sustaining rotation in a case where the number-of-rotations becomes greater than or equal to a prescribed number-of-rotations at which the internal combustion engine can perform self-sustaining rotation, and determines that the internal combustion engine cannot perform self-sustaining rotation in a case where the number-of-rotations has not become greater than or equal to the prescribed number-of-rotations.

3. The batteryless engine system according to claim 1, wherein the control unit, in a starting period of the internal combustion engine, which is started using the recoil starter, does not allow to supply electric power from the generator to the ignition apparatus, the injector, and the fuel pump while the number-of-rotations detected by the detection unit increases, and allows to supply electric power from the generator to the ignition apparatus, the injector, and the fuel pump when the number-f-rotations has stopped increasing.

4. A batteryless engine system comprising:

a fuel tank for containing fuel;

an internal combustion engine;

a generator that is driven by the internal combustion engine and produces electric power;

a recoil starter for staring the internal combustion engine;

a control unit that operates with electric power generated by the generator;

an injector that operates with electric power generated by the generator, is controlled by the control unit, and supplies fuel to the internal combustion engine;

a fuel pump that operates with electric power generated by the generator, is controlled by the control unit, and supplies fuel contained in the fuel tank to the injector;

an ignition apparatus that ignites fuel compressed in the internal combustion engine;

a power supply line that supplies electric power generated by the generator to the ignition apparatus, the injector, and the fuel pump;

a switch provided for the power supply line, the switch being switched from OFF to ON when electric power generated by the generator is supplied to the ignition apparatus, the injector, and the fuel pump, and the switch being switched from ON to OFF when electric power generated by the generator is not supplied to the ignition apparatus, the injector, and the fuel pump; and a detection unit that detects a number-of-rotations of the internal combustion engine, wherein the control unit, in a starting period of the internal combustion engine, which is started using the recoil starter, determines whether or not the internal combustion engine can perform self-sustaining rotation based on the number-of-rotations, and if the internal combustion engine cannot perform self-sustaining rotation, reduces a load for the recoil starter by not supplying electric power from the generator to the ignition apparatus, the injector, and the fuel pump by maintaining the switch being OFF, and if the internal combustion engine can perform self-sustaining rotation, supplies electric power from the generator to the ignition apparatus, the injector, and the fuel pump by switching the switch from OFF to ON, and wherein the control unit obtains acceleration from the number-of-rotations detected by the detection unit, does not supply electric power from the generator to the ignition apparatus, the injector, and the fuel pump if the number-of-rotations is less than a prescribed number-of-rotations at which the internal combustion engine can perform self-sustaining rotation, or if the acceleration is greater than or equal to a prescribed acceleration, and when the number-of-rotations becomes greater than or equal to the prescribed number-of-rotations at which the internal combustion engine can perform self-sustaining rotation and if the acceleration is less than the prescribed acceleration, supplies electric power from the generator to the ignition apparatus, the injector, and the fuel pump.

5. A batteryless engine system comprising:

a fuel tank for containing fuel;

an internal combustion engine;

a generator that is driven by the internal combustion engine and produces electric power, a recoil starter for starting the internal combustion engine;

a control unit that operates with electric power generated by the generator, an injector that operates with electric power generated by the generator, is controlled by the control unit, and supplies fuel to the internal combustion engine;

a fuel pump that operates with electric power generated by the generator, is controlled by the control unit, and supplies fuel contained in the fuel tank to the injector, an ignition apparatus that ignites fuel compressed in the internal combustion engine;

a power supply line that supplies electric power generated by the generator to the ignition apparatus, the injector, and the fuel pump;

a switch provided for the power supply line, the switch being switched from OFF to ON when electric power generated by the generator is supplied to the ignition apparatus, the injector, and the fuel pump, and the switch being switched from ON to OFF when electric power generated by the generator is not supplied to the ignition apparatus, the injector, and the fuel pump; and a detection unit that detects a number-of-rotations of the internal combustion engine, wherein the control unit;

in a period from when the recoil starter is started to be operated until the number-of-rotations becomes greater than or equal to a prescribed number-of-rotations at which the internal combustion engine can perform self-sustaining rotation or until acceleration obtained from the number-of-rotations detected by the detection unit is no longer greater than or equal to the prescribed acceleration, reduces a load for the recoil starter by not supplying electric power from the generator to the ignition apparatus, the injector, and the fuel pump by maintaining the switch being OFF; and starts supplying electric power from the generator to the ignition apparatus, the injector, and the fuel pump by switching the switch from OFF to ON after the number-of-rotations has become greater than or equal to the prescribed number-of-rotations and the acceleration is no longer greater than or equal to the prescribed acceleration.

* * * * *